United States Patent [19]

Young et al.

[11] Patent Number: 5,012,211

[45] Date of Patent: Apr. 30, 1991

[54] LOW-LOSS WIDE-BAND MICROWAVE FILTER

[75] Inventors: Frederick A. Young, Huntington Beach; Roy K. Rikimaru, Los Angeles, both of Calif.

[73] Assignee: Hughes Aircraft Company, Los Angeles, Calif.

[21] Appl. No.: 92,347

[22] Filed: Sep. 2, 1987

[51] Int. Cl.[5] ..... H01P 1/208

[52] U.S. Cl. ..... 333/212; 333/209; 333/248

[58] Field of Search ..... 333/208-212, 333/248, 21 R, 110, 126, 129, 21 A, 33-35

[56] References Cited

U.S. PATENT DOCUMENTS

| | | | |
|---|---|---|---|
| 3,697,898 | 10/1972 | Blachier | 333/21 A |
| 3,969,692 | 7/1976 | Williams et al. | 333/212 |
| 4,028,651 | 6/1977 | Leetmaa | 333/212 |
| 4,060,779 | 11/1977 | Atia et al. | 333/212 |
| 4,241,323 | 12/1980 | Griffin et al. | 333/212 X |
| 4,251,787 | 2/1981 | Young et al. | 333/209 |
| 4,262,269 | 4/1981 | Griffin et al. | 333/204 |
| 4,267,537 | 5/1981 | Karmel | 333/212 X |
| 4,477,787 | 10/1984 | Thal, Jr. | 333/208 |
| 4,489,293 | 12/1984 | Fiedziuszko | 333/212 |
| 4,513,264 | 4/1985 | Dorey | 333/212 |
| 4,571,563 | 2/1986 | Cameron | 333/212 |
| 4,644,305 | 2/1987 | Tang et al. | 333/208 |
| 4,734,665 | 3/1988 | Rosenberg et al. | 333/212 |

*Primary Examiner*—Marvin L. Nussbaum

*Attorney, Agent, or Firm*—Steven M. Mitchell; Robert A. Westerlund; Wanda K. Denson-Low

[57] ABSTRACT

A microwave filter is composed of a set of circular cylindrical cavities arranged in cascade array and interconnected by irises having cross-slotted apertures for coupling electromagnetic power in two orthogonal $TE_{113}$ modes. An input port is formed in a first of the cavities and an output port is formed in a last of the cavities. Each port is constructed as a transition between a section of rectangular waveguide and a section of circular waveguide, the section of circular waveguide being a portion of the first cavity and the last cavity, respectively, in the input and the output ports. The cross-sectional aspect ratio of the rectangular waveguide is 2:1. The ratio of a diameter of the cavity to length, as measured along a cylindrical axis in each cavity, is 0.26 thereby to provide for increased bandwidth while minimizing dispersion and transmission loss.

5 Claims, 3 Drawing Sheets

LOW-LOSS WIDE-BAND MICROWAVE FILTER

BACKGROUND OF THE INVENTION

This invention relates to plural-mode and multiple-cavity microwave filters and, more particularly, to a dual-mode microwave filter with large entrance and exit ports in lieu of input and output coupling irises for increased bandwidth and minimum losses.

Microwave bandpass filters find considerable use in microwave communication systems, as well as in radar, and signal processing circuits. Such filters are constructed to have specific passband characteristics for the transmission of a signal having prescribed bandwidth in a specific portion of the electromagnetic spectrum, while preventing the transmission of microwave signals lying outside of the passband. In the construction of such filters, it is highly desirable in many applications to provide a filter characteristic which is substantially free of frequency dispersion throughout the passband, thereby to ensure that higher and lower frequency components of a signal are equally attenuated by the filter so as to preserve the signal waveform. Preferably, such attenuation is no more than a small fraction of a decibel.

Desirable filter transmission characteristics have been obtained by providing the filters with a multiple cavity construction as is disclosed., by way of example, in U.S. Pat. Nos. 4,028,651 of Leetmaa and 4,251,787 of Young et al. The individual cavities may be separated by irises having cross-slotted apertures which enable the propagation of electromagnetic energy by waves in orthogonal modes through the filter.

A problem exists in that, upon enlargement of the passband beyond the usual range of passbands, presently available filters introduce a greater insertion loss and a greater dispersion than are desired.

SUMMARY OF THE INVENTION

It is, accordingly, an object of the invention to increase the bandwidth of a plural-mode multiple-cavity microwave filter while retaining insertion loss and dispersion at relatively low values.

This object is accomplished, in accordance with the invention, by the construction of a cylindrical microwave filter having at least three cavities which are coupled via crossed-slot irises which enable the coupling of power between the cavities in two orthogonal modes of electromagnetic waves. The length of each cavity, as measured along its cylindrical axis, is sufficient to maintain a third order mode of transverse electric wave along the cylindrical axis. Thus, there are two orthogonal waves in the form of a $TE_{113}$ mode of propagation in cylindrical coordinates.

In accordance with the invention, a high Q and wide bandwidth is achieved with minimum frequency dispersion by use of a coupling structure characterized by a large open space, as compared to the relatively small apertures of a coupling iris, and by use of a specific ratio of cavity diameter to cavity length wherein the diameter is smaller than the length by a factor of 0.26. The bandpass filter has a dual mode configuration using a mode free region of $TE_{113}$ cylindrical cavities. In a preferred embodiment of the invention, three cylindrical cavities and two crossed-slot apertures are employed with input and output coupling being accomplished by a transition from waveguide of rectangular cross section to cylindrical waveguide of circular cross section. The use of the input and output transitions in lieu of input and output irises, as have been used heretofore, accomplishes the object of the invention by allowing for increased bandwidth while minimizing loss and dispersion.

BRIEF DESCRIPTION OF THE DRAWING

The aforementioned aspects and other features of the invention are explained in the following description, taken in connection with the accompanying drawing wherein.

DETAILED DESCRIPTION

Figure 1:
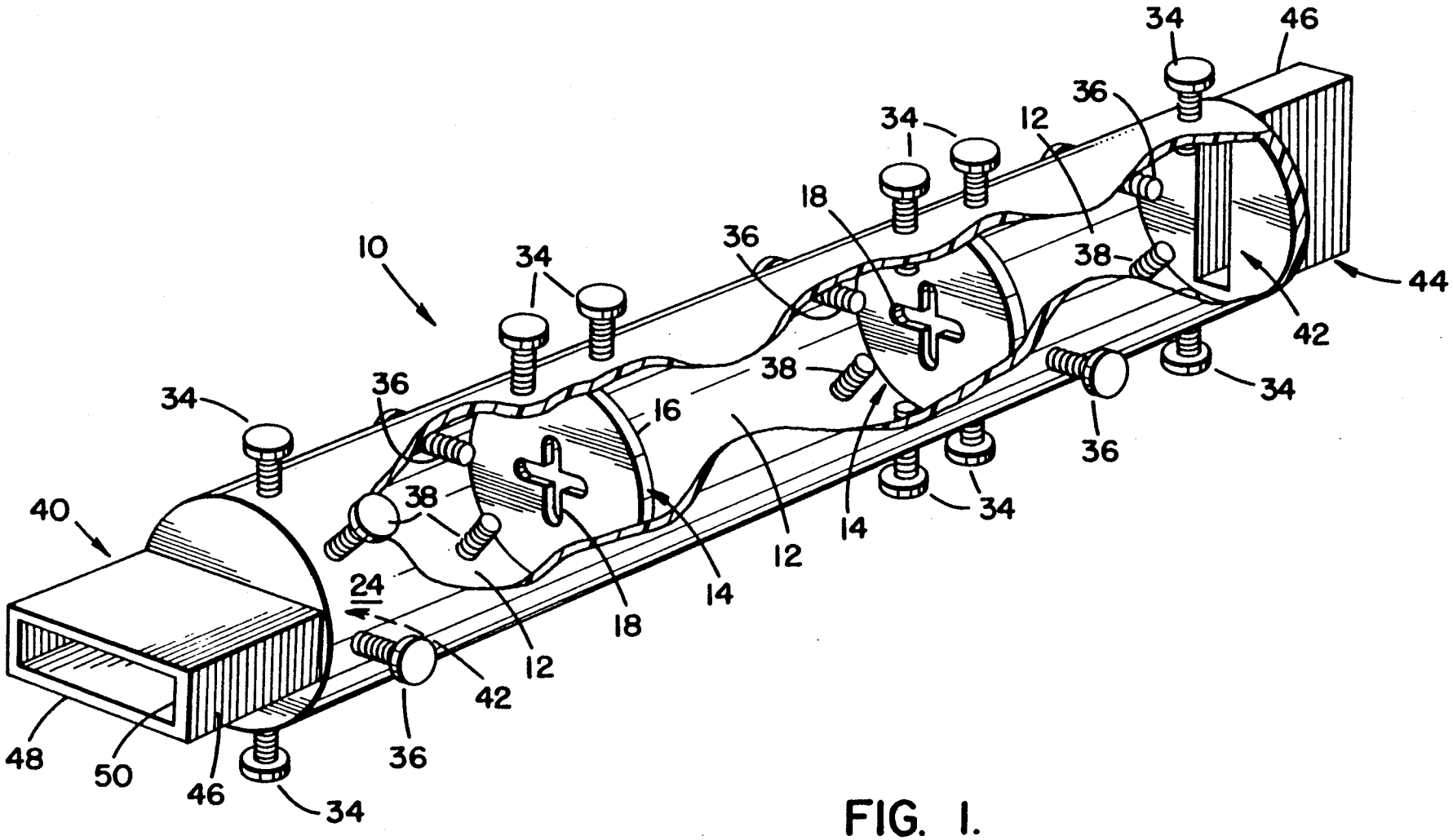
FIG. 1 is a stylized view, partially cutaway, of a microwave filter constructed of three cascaded cylindrical cavities and incorporating the invention.
Figure 2:
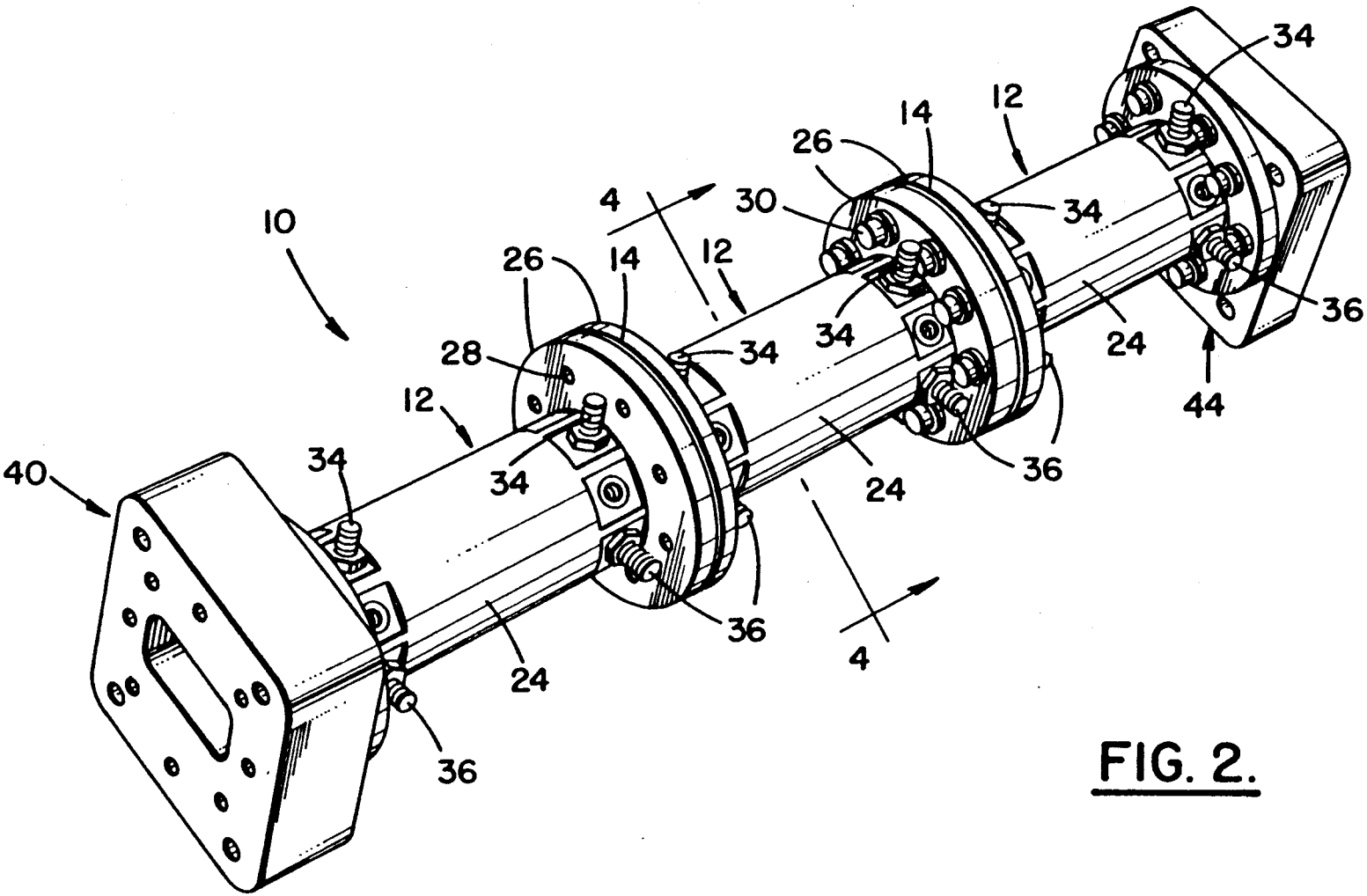
FIG. 2 is a perspective view of the filter of FIG. 1.
Figure 3:
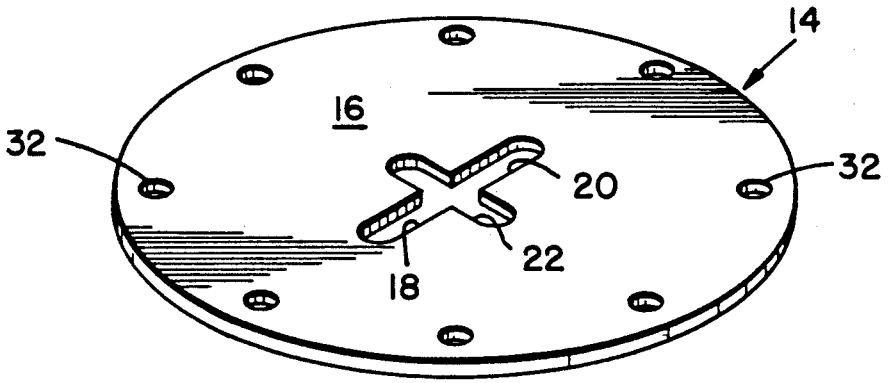
FIG. 3 shows a perspective view of an iris plate for mounting between flanges of cylindrical cavities of the filter.
Figure 4:
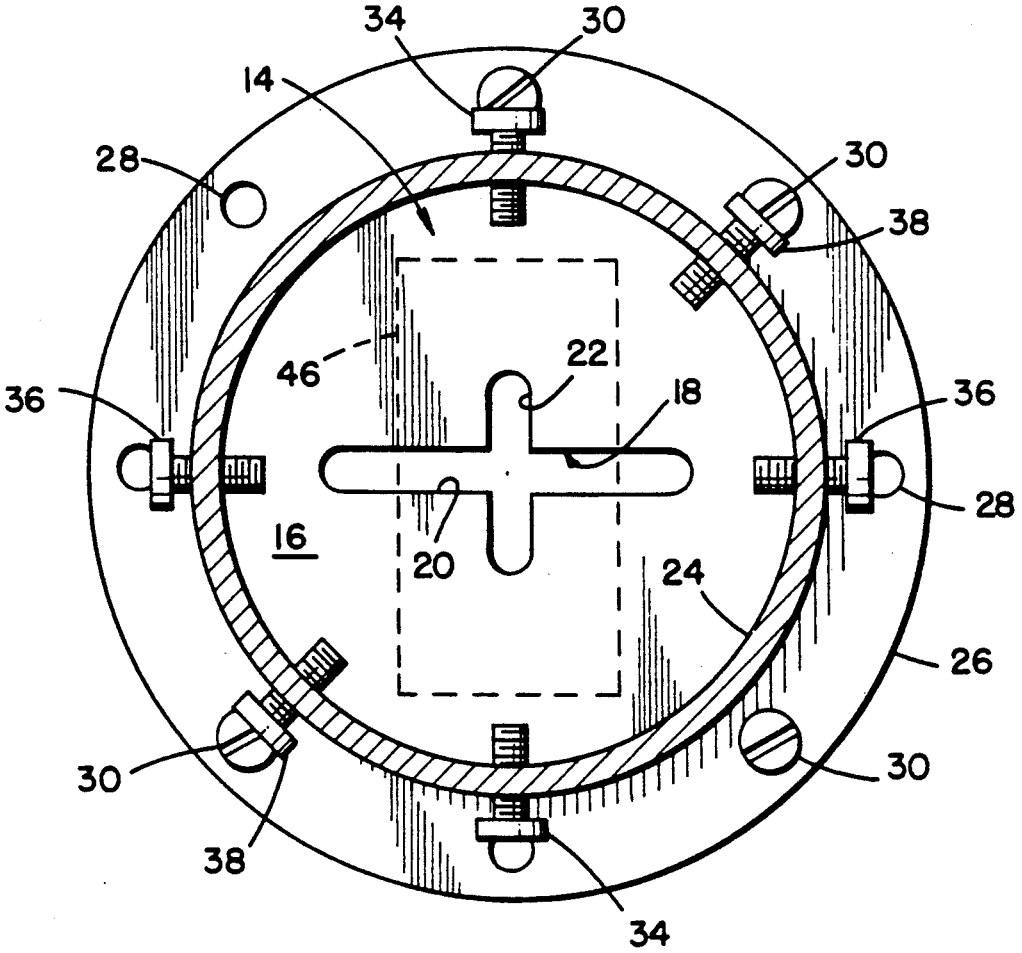
FIG. 4 is a sectional view taken along a line 4—4 in FIG. 2 showing a placement of tuning screws in a plane perpendicular to a cylindrical axis of the filter.

With reference to the figures, there is shown a microwave filter 10 having a cylindrical shape and being formed of three cavities 12 arranged serially along a central axis of the filter 10 and coupled to each other by irises 14. Each of the irises 14 is formed of a plate 16 having a crossed-slot aperture 18 in the center of the plate 16. Each aperture 18 is formed of a main arm 20 and a cross arm 22. Each cavity 12 is formed of a circular cylindrical wall 24 which terminates in a circular flange 26 having apertures 28 for receiving mounting bolts 30 by which one of the cavities 12 is attached to the next cavity 12. Some of the bolts 30 have been deleted in the drawing to show the apertures 28. Each plate 16 is provided with a peripheral array of apertures 32 for engagement with the bolts 30 to enable emplacement of an iris 14 between two consecutive cavities 12 and to be secured in position by the bolts 30. There are two irises 14, one of the irises being placed between a first and a second of the cavities 12, and the second iris 14 being placed between the second and the third of the cavities 12.

Also included within each cavity are two sets of tuning screws 34, 36, and 38, one set of the tuning screws being placed at one end of a cavity and the other set of tuning screws being placed at the opposite end of a cavity. In each set of tuning screws, there are two tuning screws 34 positioned in a vertical plane on opposite ends of a diameter of a cavity wall 24, two tuning screws 36 placed in a horizontal plane on opposite ends of a diameter of the cavity wall 24, and two tuning screws 38 placed in a diagonal plane on opposite ends of a diameter of the cavity wall 24. For clarity, some of the tuning screws have been omitted in the drawing.

In accordance with the invention, coupling at an input port 40 of the filter 10 is attained by use of a transition 42 between rectangular and circular waveguides, the circular waveguide being the first of the cylindrical cavities 12. Similarly, at an output port 44 of the filter 10 power is withdrawn via a second transition 42. In each of the ports 40 and 44, the rectangular waveguide 46 opens into a planar end wall of a cavity 12. The aspect ratio of the rectangular waveguide 46 in each of the ports 40 and 44 is 2:1 wherein a broad sidewall 48 of the rectangular waveguide is twice the cross-sectional length of a narrow sidewall 50 of the rectangular waveguide 46. The broad sidewall 48 of the input port 40 is coplanar with the broad sidewall 48 of the output port 44. Also, each of the broad sidewalls 48 is parallel to the main arm 20 in each of the irises 14. The plane of the broad sidewalls 48 is disposed horizontally and is perpendicular to a plane containing the tuning screws 34 in each of the cavities 12.

In accordance with an essential feature of the invention, in each of the cavities 12, the interior axial diameter is smaller than the interior length by a factor of 0.26. This permits the coupling of electromagnetic power via the transitions 42 in the ports 40 and 44 to be accomplished with superior results than by the use of additional irises, (not shown) which have been used heretofore at the input and output ports 40 and 44. Indeed, the manner of coupling is such as to provide for an enlargement of the bandwidth and a reduction in dispersion and insertion loss upon connection of the filter 10 to other microwave components (not shown) of a microwave circuit.

Each of the rectangular waveguides 46 carries a TE10 mode of electromagnetic wave, which wave splits into two orthogonal $TE_{113}$ waves within the cavity 12 at the input port 40. Similarly, at the transition 42 of the output port 44, the two $TE_{113}$ waves in the third of the cavities 12 are converted to a single TE10 wave at the output port 44. The magnitudes of the waves, and the amount of each of the waves coupled from cavity to cavity, as well as cross coupling between the two sets of waves is established by use of the tuning screws 34, 36, and 38 in a manner well known in the design of microwave components. Also, the operation of the filter 10 is reciprocal in the sense that power can be applied to the output port and extracted from the input port.

By way of example in the use of the filter 10 of the invention, it is noted that a low loss bandpass filter is necessary to protect communication repeaters against unwanted signals while establishing a desired noise bandwidth. The use of the filter 10 is accomplished without introducing excessive insertion loss across the communication band. Extremely low loss bandpass filters are preferred for this task.

Continuing with this example, and considering the case of an uplink frequency of 14 GHz (gigahertz), the Q of 4,000 has been achieved by the filter 10, this resulting in an insertion loss of 0.4 dB (decibels) at the band edges of a communication passband. In the case of an unloaded Q in excess of 10,000, the band-edge insertion loss is reduced to less than 0.2 dB. This high value of Q is achieved by use of the higher order cylindrical $TE_{113}$ mode, while attaining in excess of 4% bandwidth at 14 GHz. Such performance has been attained by use of the transitions 42 and the ratio of diameter to length of 0.26. These constructional features have also minimized frequency dispersion over the passband, the filter providing an elliptic response over the passband. This construction is particularly useful for Ku band communication receivers which, because of the characteristics of the filter 10, have attained a reduction in noise figure while providing the proper repeater noise bandwidth.

In operation, therefore, a dual mode $TE_{113}$ cylindrical cavity bandpass filter is developed with a ratio of cavity diameter to length of 0.26 in each of the cavities 12. The energy transfer from one cavity to a neighboring cavity is achieved by relatively large apertures 18 in the irises 14 to minimize spurious reactances. The input and the output couplings established by the transitions 42 maximize energy transfer for wide bandwidth applications. The coupling of the transitions 42 is designed to maximize energy transfer without introducing frequency dispersion, such dispersion having the deleterious effect of passband sloping of the attenuation characteristic as a function of frequency. The cavity lengths are optimized to minimize forced tuning by use of the tuning screws 34, 36, and 38, thereby to enhance the unloaded Q of each cavity 12. Furthermore, the cavity tuning screws 34 and 36 and the coupling screws 38 are located in each cavity 12 so as to ensure that the modes are excited equally in the outer standing waves. A center standing wave is not disturbed.

In the construction of filters composed of cylindrical cavities, the usual practice is to select an operating frequency and a desired mode of electromagnetic wave within the cavity. The diameter of the cavity is selected in a well-known fashion as a function of the desired operating frequency of the cavity. Thereupon, in accordance with the invention, the correct ratio of diameter to length is selected to enable the filter to couple power through the ports 40 and 44 by means of the transitions 42 to accomplish the wideband high Q operation of the filter 10.

It is to be understood that the above described embodiment of the invention is illustrative only, and that modifications thereof may occur to those skilled in the art. Accordingly, this invention is not to be regarded as limited to the embodiment disclosed herein, but is to be limited only as defined by the appended claims.

What is claimed is:

1. A microwave filter comprising:

a series of cavities interconnected in a cascade fashion between an input port and an output port of said filter, each of said cavities having a circular cylindrical shape;

a plurality of irises, individual ones of said irises being located at interfaces between successive ones of said cavities, each iris having an aperture configuration for coupling two orthogonal electromagnetic waves between cavities;

a first of said cavities being bounded at one end thereof by an end wall located at said input port and, at a second end thereof, by an iris located at the interface with the next cavity; a last one of said cavities being bounded at a second end thereof by an end wall located at said output port and, at a first end thereof, by an iris located at the interface with the preceding cavity;

an input transition located at said input port and an output transition located at said output port, each of said transitions comprising a section of rectangular waveguide opening into an end wall of a cavity; and wherein each of said cavities has a length selected to sustain a $TE_{113}$ mode of electromagnetic wave within the cavity, and in each cavity, the diameter of a cavity is smaller than the length thereof by a factor of 0.26 for increased bandwidth and decreased transmission loss.

2. A filter according to claim 1 wherein said end walls are planar.

3. A filter according to claim 1 wherein said rectangular waveguide has a broad wall and a narrow wall, and wherein, in cross-section, the ratio of broad wall to narrow wall is 2:1.

4. A filter according to claim 1 wherein there are three of said cavities and two of said irises, and wherein an aperture in each of said irises has the configuration of a crossed slot.

5. A filter according to claim 4 wherein said end walls are planar, and wherein said rectangular waveguide has a broad wall and a narrow wall, and wherein, in cross-section, the ratio of broad wall to narrow wall is 2:1.

* * * * *